United States Patent [19]

Meyer et al.

[11] 4,008,576

[45] Feb. 22, 1977

[54] METHOD OF SECURING OBJECTS IN PASSAGES AND ARRANGEMENT OBTAINED THEREBY, PARTICULARLY HOSE LINES SEALINGLY SECURED IN THE PASSAGES OF COAL MINES FOR DUST SUPPRESSION

[75] Inventors: Frank Meyer; Helmut Becker, both of Essen; Heinz Goretz, Gelsenkirchen-Buer, all of Germany

[73] Assignee: Bergwerksverband GmbH, Essen, Germany

[22] Filed: Sept. 9, 1974

[21] Appl. No.: 503,899

[30] Foreign Application Priority Data

Sept. 8, 1973 Germany ..... 2345393

[52] U.S. Cl. ..... 61/36 R; 61/42; 61/45 B; 61/63; 61/85; 299/12

[51] Int. Cl.[2] ..... E21C 35/22

[58] Field of Search ..... 61/36, 45 B, 35, 72.1; 285/297, 294, 192, 189; 299/12

[56] References Cited

UNITED STATES PATENTS

| | | | |
|---|---|---|---|
| 3,224,796 | 12/1965 | Burkitt | 285/294 X |
| 3,325,195 | 6/1967 | Margis | 285/294 |
| 3,391,101 | 7/1968 | Kelly et al. | 285/294 X |
| 3,403,520 | 10/1968 | Goodman | 61/50 X |
| 3,430,449 | 3/1969 | Novotny et al. | 61/45 B |

FOREIGN PATENTS OR APPLICATIONS

| | | | |
|---|---|---|---|
| 1,078,580 | 5/1954 | France | 285/297 |
| 2,126,344 | 12/1972 | Germany | 299/12 |
| 45-23381 | 1/1970 | Japan | 61/45 B |

*Primary Examiner*—Jacob Shapiro
*Attorney, Agent, or Firm*—Michael J. Striker

[57] ABSTRACT

An object extends into a passage and defines a clearance space with the inner wall of the passage. A hardenable, foamable synthetic resin in flowable state is admitted into the clearance space. Upon hardening and foaming of the synthetic resin, the object is sealingly secured in the passage by the synthetic resin. In a preferred application, the passage is one provided in a coal mine and the object is a hose line for the purpose of suppressing dust. The synthetic resin is advantageously polyurethane including a polyhydroxyl component which contains a polyetherglycol having a hydroxyl number of 300 to 350 and a polyetherglycol having a hydroxyl number of 450 to 500. The polyetherglycol components respectively constitute 80 to 90 parts and 10 to 20 parts of the polyhydroxyl component. The polyhydroxyl component preferably includes a filler in an amount such that the weight of the latter at least equals that of the polyhydroxyl component.

26 Claims, 1 Drawing Figure

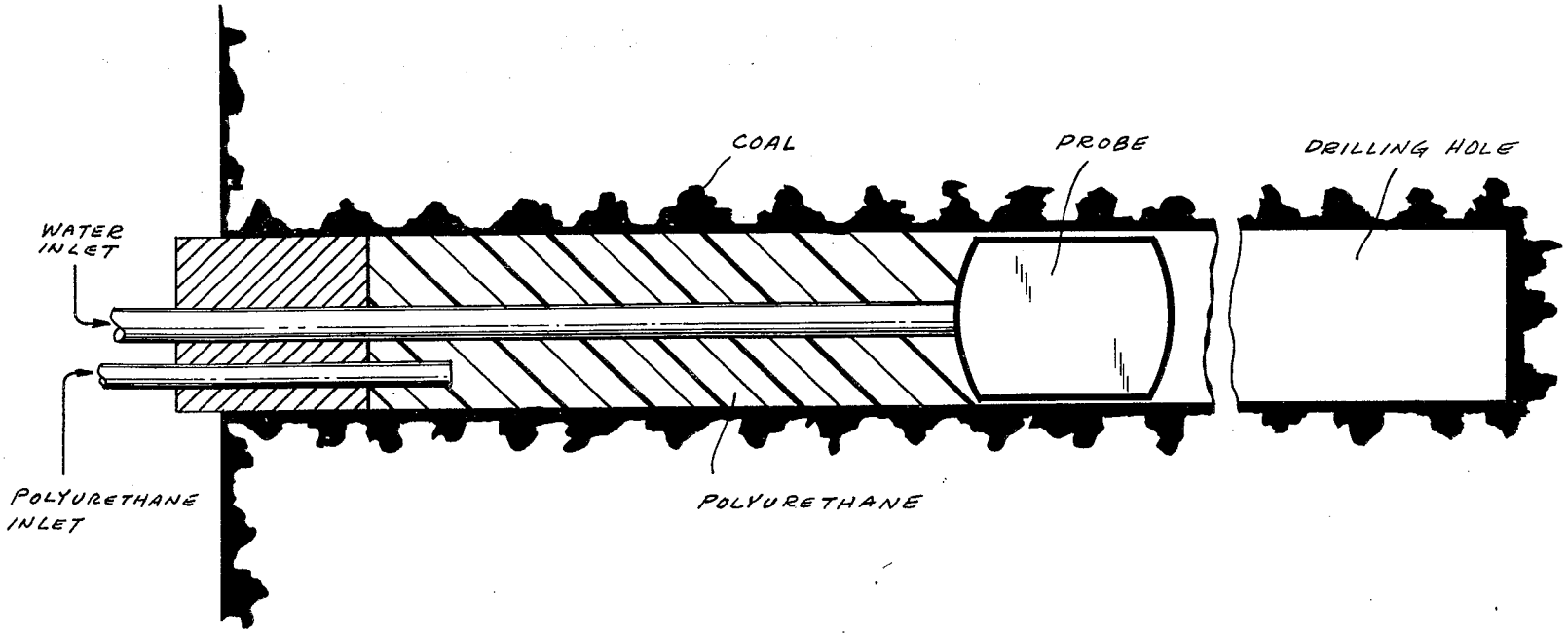
DRILLING HOLE
PROBE
COAL
POLYURETHANE
WATER INLET
POLYURETHANE INLET

METHOD OF SECURING OBJECTS IN PASSAGES AND ARRANGEMENT OBTAINED THEREBY, PARTICULARLY HOSE LINES SEALINGLY SECURED IN THE PASSAGES OF COAL MINES FOR DUST SUPPRESSION

BACKGROUND OF THE INVENTION

The invention relates generally to the securing of objects in passages. Of particular interest to the invention are the hose lines used in coal mines for the purpose of dust suppression, which hose lines are arranged in boreholes.

In order to suppress dust in coal mining such as, for instance, in the mining of bituminous coal, boreholes leading to sources of dust are formed and hose lines are arranged in the boreholes so that these sources may be wetted or soaked with water. It is necessary here, for the various soaking methods, that the hose lines be durably and firmly sealed in the boreholes. In the conventional, continuous soaking methods, the seal for the lines and the probes must extend over a distance of at least 15 meters in order to be able to withstand the water pressure which builds up, for example, in the coal face, during the course of the soaking procedure. This water pressure may attain values of up to 350 bars.

As a rule, the sealing of the free space between the wall of the hose line and the wall of the borehole is accomplished by means of a cement slurry. Where the borehole extends in downward direction, the cement slurry is poured into the borehole whereas, for boreholes which extend in upward direction, the cement slurry is pumped into the borehole. The cement slurry usually sets no sooner than 24 hours after being poured or pumped. It is only after setting has occurred that the soaking operation may be begun.

The long setting time of a least 24 hours required for the cement slurry makes it impossible to produce the borehole, seal the probes and hose lines and begin the soaking operation within a single shift. The loss, for soaking purposes, of the period of time corresponding to the setting period is particularly serious in those cases where the advancing longwall system is used and greatly influences the dust suppression in an adverse manner. Also, the long setting time results in relatively high labor expenditures and, consequently, in high costs.

A further disadvantage of the method outlined above resides in the fact that the seal obtained after setting or hardening is brittle. Thus, when ground movements or ground shifting occur, as is frequently the case underground, the brittle sealing mass cracks at various locations. In many instances, this leads to breaks in the seal which, in turn, often requires stoppage of the soaking procedure since the water leaks out at the broken locations and does not penetrate the source of dust such as, for instance, the coal face.

There further exists the disadvantage that lumps often form during mixing of the cement slurry and these may cause substantial disturbances in the operation when the slurry is forced into upwardly extending boreholes since the pump used for this purpose can then no longer work freely. Moreover, the production of the cement slurry in underground operations poses risks from a hygienic point of view since cement dust may be drawn along by the fresh air draft provided and may lead to skin irritations.

SUMMARY OF THE INVENTION

It is a general object of the invention to provide a novel method for securing objects in passages.

Another object of the invention is to provide a method which enables objects to be secured in passages more rapidly than was possible heretofore.

A further object of the invention is to provide a method which enables objects to be secured in passages with a risk of disturbances which is less than that achieveable until now.

An additional object of the invention is to provide a method which enables objets to be secured in passages with less hygienic risk than was possible heretofore.

It is also an object of the invention to provide a method of sealingly securing objects in passages which enables seals having a greater elasticity than obtainable until now to be achieved.

Still another object of the invention is to provide a method for use in excavations such as coal mines and the like and which enables fluid-conveying elements to be sealingly secured in boreholes and the like more simply, more rapidly and more economically than was possible heretofore while permitting seals having a greater elasticity than obtainable until now to be achieved and which, at the same time, enables hygienic risks to be reduced to levels below those achievable heretofore.

Yet one more object of the invention is to provide an arrangement wherein an object is secured in a passage and which may be produced more simply and economically than was possible until now.

It is a further object of the invention to provide an arrangement wherein an object is secured in a passage and which may be produced more rapidly and with lesser hygienic risks than heretofore.

Another object of the invention is to provide an arrangement wherein an object is sealingly secured in a passage and the seal has a greater elasticity than was achieveable until now.

An additional object of the invention is to provide an arrangement in the form of an excavation such as a coal mine or the like wherein a fluid-conveying element is sealingly secured in a borehole or the like and which may be produced more simply, more rapidly, more hygienically and more economically than was possible heretofore with a seal having a greater elasticity than obtainable until now.

These objects, as well as others which will become apparent hereinafter, are achieved in accordance with the invention. One aspect of the invention resides in a method of securing an object in a passage having an inner wall and wherein the object at least partially extends into the passage so as to define a clearance space with the inner wall. The method is particularly well-suited for use in excavations such as coal mines and the like for sealingly securing fluid-conveying elements in passages which communicate with sources of dust so as to permit wetting or soaking of the sources and thereby suppress the escape of dust therefrom. The method includes the improvement which comprises admitting a hardenable, foamable synthetic resin into the clearance space in flowable state so as to permit hardening and foaming of the synthetic resin in the clearance space to thereby secure the object in the passage.

Another aspect of the invention resides in an arrangement wherein an object at least partially extends into a passage having an inner wall so as to define a clearance space with the inner wall, and particularly in arrangements in the form of excavations such as coal mines and the like wherein fluid-conveying elements extend into passages which communicate with sources of dust so as to permit wetting or soaking of the sources and thereby suppress the escape of dust therefrom. The arrangement includes the improvement which comprises a hardened, foamed synthetic resin accommodated in the clearance space and securing the object in the passage.

DESCRIPTION OF THE PREFERRED EMBODIMENTS

As already indicated, of particular interest to the invention are applications relating to mines, especially coal mines such as, for example, bituminous coal mines, and, accordingly, the discussion herein will be primarily with reference thereto.

In coal mines or excavations, particularly underground excavations, there arises the problem of suppressing dust. Particular examples of dust which may be created in coal mines are coal dust and rock dust. Sources of the dust include rock and the coal face. In order to suppress the dust, that is, in order to prevent the escape of the dust into the atmosphere, the dust sources may be wetted or soaked with a suitable fluid such as, for instance, water. For this purpose, boreholes or passages are provided which lead to or communicate with the dust sources and fluid-conveying elements such as hose lines or hose pipes are arranged in the passages. Since high pressures, i.e. up to 350 bars, may be generated during wetting of the dust sources, the fluid-conveying elements should be firmly secured in the passages. Moreover, it is desirable for the fluid-conveying elements to be sealingly secured in the passages, that is, for seals to be provided between the outer walls of the fluid-conveying elements and the inner walls of the passages. It will be understood that terms such as "sealingly secured" herein mean that the seal is liquid-tight.

The fluid-conveying element extends through its passage with clearance or, in other words, a free space or clearance space is defined between the outer wall of the fluid-conveying element and the inner wall of the passage. The clearance space may, for instance, be of annular configuration. The substance which secures the fluid-conveying element in the passage is normally entirely accommodated in the clearance space. The manner in which the prior art attempts to sealingly secure hose lines or hose pipes in boreholes has been described earlier.

In accordance with the invention, the disadvantages, as outlined previously, associated with the sealing techniques used heretofore may be overcome by providing for the sealing of the clearance space between the fluid-conveying elements and the inner wall of the passage to be accomplished by means of a foamable, hardenable synthetic resin. Preferably, the synthetic resin is rapidly hardening synthetic resin. Although synthetic resins of this type result in a mass which contains pores, the seal is nevertheless absolutely water-tight even under the highest pressures. Simultaneously, the seal possesses adequate elasticity to resist ground movements or ground shifting.

Advantageously, the volume of the foamed synthetic resin is about four times that of the starting material at most, that is, it is of advantage when the volume of the foamed synthetic resin is, at a maximum, about four times the volume of the synthetic resin in the flowable state in which it is introduced into the clearance space. Preferably, the volume of the foamed synthetic resin is approximately three to four times that of the synthetic resin in the flowable state in which it is introduced into the clearance space. It is further of advantage when the synthetic resin is selected in such a manner that hardening thereof is already completed within one hour.

According to the invention, the synthetic resin advantageously comprises polyurethane. The polyurethane may include a polyhydroxyl component which comprises a substance having a hydroxyl (OH) number of about 450 to 500. The polyhydroxyl component may contain approximately 10 to 20 parts of this substance and the substance may be a reactive polyetherglycol. On the other hand, the polyurethane may include a polyhydroxyl component which comprises a polyetherglycol having a hydroxyl (OH) number of about 300 to 350. The polyhydroxyl component may contain approximately 80 to 90 parts of the latter substance and this substance may be a less reactive polyetherglycol.

In accordance with the invention, the conditions outlined above with respect to the synthetic resin are particularly well-fulfilled by a polyurethane containing a polyhydroxyl component which comprises a mixture of a reactive polyetherglycol having a hydroxyl number of about 450 to 500 and a less reactive polyetherglycol having a hydroxyl number of about 300 to 350. The polyhydroxyl component may contain approximately 10 to 20 parts of the reactive polyetherglycol and approximately 80 to 90 parts of the less reactive polyetherglycol.

A plasticizer is advantageously added to the polyetherglycol and examples of suitable plasticizers are castor oil and tall oil. A certain quantity of water may also be added to the polyetherglycol and this quantity preferably does not exceed about 3 to 4 percent.

Assuming that polyurethane is to be used for the hardenable, foamable synthetic resin to be introduced into the clearance space so as to form a sealing mass therein, it is possible to proceed by forming, for example, a mixture of equal volumes of the polyhydroxyl component and a diisocyanate. This mixture, which is in flowable state, may be poured into the passage if the passage extends in a downward direction or, if the passage extends in an upward direction, may be brought into the passage by means of a pump which is known per se. The sealing mass is, with advantage, prepared in such a manner that, as calculated on the basis of the starting volume, a three- fold foaming up is achieved. It is also favorable for the hardened, foamed synthetic resin to substantially fill the clearance space.

In order to save on synthetic resin, the sealing mass may be extended with suitable fillers which are preferably inert, examples being rock dust, alkaline earth metal carbonates and quartzsand. Thus, for the case of polyurethane, it is possible to add a filler to the polyhydroxyl component thereof. The filler may be added in such quantities that the weight thereof is as much as that of the polyhydroxyl component. It is advantageous when the weight of the filler is at least equal to that of the polyhydroxyl component and the weight of the filler may, for example, amount to three times that of the polyhydroxyl component.

The invention achieves a flexible and liquid tight sealing of the clearance space between the wall of the hose line and the wall of the bore hole within a maximum of one to two hours.

The following Examples are intended to further illustrate the invention and are not intended to limit the latter. In the Examples, reference will be made to certain components which are identified as follows:

Component A: diisocyanate of dipheylmethane (Product Baymidur K 88 manufactured by Bayer AG, 609 Leverkusen, Germany-West).

Component B:

1. polyetherglycol having a hydroxyl number of 300 to 350
2. polyetherglycol having a hydroxyl number of 450.

The components B (1) and B (2) were produced by reaction between trimethylolpwpane and propylene oxide, as described for instance in "Ullmann 1963, Bd 14, P 50 - 51".

EXAMPLE 1

A duct having a length of 18 meters, a diameter of 50 millimeters and a downward inclination of 15°–20° is prepared. Subsequently, a soaking probe and feed line are placed in the borehole so as to extend for a distance of about 15 meters therealong. The prove is braced in the borehole by means of a low water pressure.

In this case, component B is made up of 90 parts B(1) and 10 parts B(2). Five liters of each of components A and B are thoroughly mixed and then filled into the borehole. Component B further contains 1 percent of water and 12 percent of castor oil. After one hour of hardening time, the soaking operation is begun. One hour later the water pressure is 60–80 atmospheres in excess of atmospheric pressure. After 2 weeks, the water pressure has risen to 180 atmospheres in excess of atmospheric pressure. The seal is completely water-tight.

EXAMPLE 2

A soaking probe and feed line are braced over a distance of 18 meters, as outlined in Example 1, in a borehole having a length of 20 meters. The borehole has an upward inclination of about 10°.

Sealing is accomplished using a mixture formed from five liters of each of components A and B. Component B is here made up of 80 parts of B(1) and 20 parts of B(2) and contains 1.5 percent of water and 14 percent of castor oil. After one hour of hardening time, the soaking operation is begun. During the course of one hour thereafter, the water pressure rises to 120 atmospheres in excess of atmospheric pressure. The borehole is completely water-tight.

EXAMPLE 3

A borehole having a length of 22 meters and an upward inclination of about 15° is prepared. A probe and feed line are placed in the borehole so as to extend for a distance of about 18 meters therealong.

Six liters of each of components A and B are thoroughly mixed and admitted into the borehole by means of a pump. Component B here has the same composition as in Example 1 with the exception that, in the present instance, 100 weight parts of an inert material (here rock dust) are added to component B. The soaking operation may already be begun after 45 minutes. During the course of three weeks, the water pressure rises to 220 atmospheres in excess of atmospheric pressure. The borehole is completely water-tight.

It will be understood that each of the elements described above, or two or more together, may also find a useful application in other types of methods and arrangements differing from the types described above.

While the invention has been illustrated and described as embodied in a method of sealingly securing hose lines in the boreholes of coal mines for dust suppression and arrangement made thereby, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of securing liquid-conveying elements for dust suppression in mines, comprising forming an underground passage which opens to a source of dust in a mine; positioning a liquid- conveying element in such a manner that said element extends along said passage and is arranged to permit impingement of said dust source by a stream of liquid to thereby wet said dust source and suppress the escape of dust therefrom, said element defining a clearance space with the inner wall of said passage; admitting into said space a hardenable synthetic resin which is in flowable state; hardening said resin in said space to thereby secure said element in said passage; and connecting said element with a source of liquid.

2. A method as defined in claim 1, wherein said mine is a coal mine.

3. A method as defined in claim 1, wherein said synthetic resin sealingly secures said element in said passage.

4. A method as defined in claim 1, wherein said synthetic resin substantially fills said space subsequent to said hardening thereof.

5. A method as defined in claim 1, wherein the volume of said synthetic resin subsequent to said hardening and foaming is at most about four times the volume of said synthetic resin in said flowable state.

6. A method as defined in claim 5, wherein the volume of said synthetic resin subsequent to said hardening and foaming is approximately three to four times the volume of said synthetic resin in said flowable state.

7. A method as defined in claim 1, wherein said synthetic resin comprises polyurethane.

8. A method as defined in claim 5, said polyurethane including a polyhydroxyl component; and wherein said component comprises a substance having a hydroxyl number between substantially 300 and 350.

9. A method as defined in claim 6, wherein said component comprises approximately 80 to 90 parts of said substance.

10. A method as defined in claim 8, wherein said substance is a polyetherglycol.

11. A method as defined in claim 7, said polyurethane including a polyhydroxyl component; and wherein said component comprises a substance having a hydroxyl number between approximately 450 and 500.

12. A method as defined in claim 4, wherein said component comprises approximately 10 to 20 parts of said substance.

13. A method as defined in claim 11, wherein said substance is a polyetherglycol.

14. A method as defined in claim 7, wherein said polyurethane is foamable and comprises a polyhydroxyl component containing about 80 to 90 parts of a polyetherglycol having a hydroxyl number between about 300 and 350, said component also including about 10 to 20 parts of a polyetherglycol having a hydroxyl number between about 450 and 500.

15. A method as defined in claim 7, said polyurethane including a polyhydroxyl component; and wherein said component comprises a filler.

16. A method as defined in claim 15, wherein the weight of said filler at least equals the weight of said component.

17. A method as defined in claim 1, wherein said synthetic resin is foamable and foams subsequent to the admission thereof into said space.

18. An arrangement for the suppression of dust in mines, comprising a mine having a source of dust; an underground passage communicating with said dust source; a liquid-conveying element at least partially extending into said passage and defining a clearance space with the inner wall of said passage, said element being connected with a source of liquid and being arranged so as to permit impingement of said dust source by a stream of liquid to thereby wet said dust source and suppress the escape of dust therefrom; and a hardened synthetic resin accommodated in said clearance space and securing said element in said passage.

19. An arrangement as defined in claim 18, wherein said synthetic resin sealingly secures said element in said passage.

20. An arrangement as defined in claim 18, wherein said synthetic resin comprises polyurethane.

21. An arrangement as defined in claim 20, wherein said polyurethane is foamed and comprises a polyhydroxyl component containing about 80 to 90 parts of a polyetherglycol having a hydroxyl number between about 300 and 350, said component also including about 10 to 20 parts of a polyetherglycol having a hydroxyl number between about 450 and 500.

22. An arrangement as defined in claim 20, said polyurethane including a polyhydroxyl component; and wherein said component comprises a filler in an amount such that the weight of said filler at least equals the weight of said component.

23. An arrangement as difined in claim 18, wherein said mine is a coal mine.

24. An arrangement as defined in claim 22, said synthetic resin being foamed; and wherein said synthetic resin comprises a polyurethane, said polyurethane comprising a polyhydroxyl component which includes approximately 80 to 90 parts of a polyetherglycol having a hydroxyl number between about 300 and 350.

25. An arrangement as defined in claim 23, said synthetic resin being foamed; and wherein said synthetic resin comprises a polyurethane, said polyurethane comprising a polyhydroxyl component which includes approximately 10 to 20 parts of a polyetherglycol having a hydroxyl number between about 450 and 500.

26. An arrangement as defined in claim 18, wherein said synthetic resin is foamed.

* * * * *